US005196031A

United States Patent [19]

Hook

[11] Patent Number: 5,196,031

[45] Date of Patent: Mar. 23, 1993

[54] EXHAUST DYEING PROCESS FOR MIXED FIBRE SUBSTRATE IN SINGLE BATH: DISPERSE DYE, COPPER COMPLEX DYE, COMPLEXING AGENT AND OXIDIZING AGENT

[75] Inventor: John A. Hook, Bradford, Great Britain

[73] Assignee: Sandoz Ltd., Basel, Switzerland

[21] Appl. No.: 750,339

[22] Filed: Aug. 27, 1991

Related U.S. Application Data

[63] Continuation of Ser. No. 464,476, Jan. 12, 1990, abandoned, which is a continuation of Ser. No. 307,437, Feb. 7, 1989, abandoned.

[30] Foreign Application Priority Data

Feb. 8, 1988 [GB] United Kingdom ..... 8802794

[51] Int. Cl.[5] ..... B01F 17/50; D06P 1/65; D06P 3/87; D06P 5/08

[52] U.S. Cl. ..... 8/531; 8/532; 8/543; 8/584; 8/597; 8/599; 8/602; 8/624; 8/634; 8/680; 8/685

[58] Field of Search ..... 8/531, 532, 624, 685

[56] References Cited

U.S. PATENT DOCUMENTS 4,752,299 6/1988 Annen et al. ..... 8/531

FOREIGN PATENT DOCUMENTS 52-103574 8/1977 Japan .

*Primary Examiner*—A. Lionel Clingman

*Attorney, Agent, or Firm*—Gerald D. Sharkin; Richard E. Vila; Thomas C. Doyle

[57] ABSTRACT

A process for dyeing a mixed fibrous substrate comprising applying to the substrate, a) at least one disperse dye, b) at least one copper - containing direct or reactive dye, preferably in a sufficient amount to produce a dyeing greater than a 1/1 standard depth;

c) a complexing agent having a stability constant (K-value) with the metal of the direct or reactive dye of from 6 to 17 inclusive;

d) a lignin sulphonate dispersing agent; and e) an oxidizing agent capable of converting copper (I) to copper (II) at a temperature of 100°-130° C. at a pH of 5-7 in the process for dyeing the mixed substrate.

32 Claims, No Drawings

EXHAUST DYEING PROCESS FOR MIXED FIBRE SUBSTRATE IN SINGLE BATH: DISPERSE DYE, COPPER COMPLEX DYE, COMPLEXING AGENT AND OXIDIZING AGENT

This is a continuation of application Ser. No. 07/464,476, filed Jan. 12, 1990, now abandoned which in turn is a continuation division of application Ser. No. 07/307,437, filed Feb. 7, 1989, now abandoned.

The invention relates to a process for dyeing, in a single bath a mixed substrate dyeable with a disperse dye and a metal containing direct and/or reactive dye.

One of the problems relating to dyeing polyester- or polyamide-cellulosic blends of fibers with a disperse and a metal-containing direct or reactive dye is that the free metal ions (not complexed to the dye molecule) naturally accompanying the direct or reactive dye interfere with the disperse dye causing a change in the shade of dyeings produced. This in turn affects the reproductibility of the shades produced by the disperse dyes.

It has been found that complexing agents such as citric acid will alleviate these problems generally. However it was found that when deeper dyeings generally than 1/1 standard depth were required and generally when the dispersing agent used was of the lignisulphonate series, the familiar disperse dye destruction could be seen again and that this destruction could not be fully compensated for by the addition of extra complexing agent, such as citric acid alone.

To alleviate this problem, there is provided according to the invention, a process for dyeing a mixed fibrous substrate dyeable with a disperse dye and a metal containing direct or reactive dye comprising applying to the substrate, a) at least one disperse dye,
b) at least one copper-containing direct or reactive dye, preferably in a sufficient amount to produce a dyeing greater than a 1/1 standard depth on the substrate;
c) a complexing agent having a stability constant (K-value) with the metal of the direct or reactive dye of from 6 to 17 inclusive;
d) a lignin sulphonate dispersing agent; and
e) an oxidising agent capable of converting copper (I) to copper (II) at a temperature of 100°–130° C. at a pH of 5–7 in the process for dyeing the mixed substrate.

Preferably components a) to e) are applied at the same time to the substrate,

Preferred direct dyes used in a process according to the invention are heavy metal complex (preferably azo) dyes, more preferably C.I. Direct Red 261,
C.I. Direct Blue 90, and
C.I. Direct Brown 240.

Usually the disperse dye will be available as a disperse dye and a lignin sulphonate dispersing agent in a powder or presscake form.

The above-mentioned direct dyes are copper-containing and the free copper that is associated with them, in the absence of the complexing agents of the process of the present invention, is such as to cause a noticeable adverse effect (i.e. tend to destroy) on the disperse dye dyeing of polyester or polyamide material.

Preferred reactive dyes are heavy metal complex (preferably azo) dyes, more preferably those copper-containing reactive dyes that have an appreciable effect (i.e. tend to destroy) on the disperse dye of a disperse dyeing of polyester or polyamide material.

The preferred disperse dyes that are used in a process according to the invention are those that are susceptible to shade change by metals according to modified ISO Test Z02. The modification to ISO Test Z02 is that the polyester dyeing is carried out in the presence of a metal salt at 130° C. instead of 98° C. More preferably the disperse dyes are those having values of less than 4–5 according to the modified ISO Test Z02, most preferably in the range 1–4.

Preferred disperse dyes used in a process according to the invention are:

C.I. Disperse Blue 79.
C.I. Disperse Blue 81,
C.I. Disperse Blue 180,
C.I. Disperse Blue 183,
C.I. Disperse Blue 291,
C.I. Disperse Violet 63,
C.I. Disperse Violet 93:1.
C.I. Disperse Blue 56 and
C.I. Disperse Blue 73.

Preferred complexing agents according to the invention are selected from citric acid, biguanide, amino trimethylenephosphonic acid, ethylene diamine and glycine and derivatives (such as salts) of each of the above complexing agents.

A description of K-values is given in the Handbook "Stability Constants of Metal Ion Complexes": Section I: Organic Ligands (L. G. Sillen) and Section II: Inorganic Ligands (A. E. Martell)—published by the Chemical Society (London-1964). The definition of K is given on pages x–xvii of the above Handbook and is incorporated herein by reference.

Preferably where a metal and a complexing agent have more than one K value, the K value referred to in this Specification is that for the metal and complexing agent in a medium at pH from 4 to 5.5 (preferably at a temperature of 100° to 140° C.).

Preferably K is from 10 to 17 inclusive.

Preferably the oxidising agent is a strong oxidising agent at pH 5° and 130° C. and is substantially colourless. More preferably the oxidising agent has a Standard Electrode Potential ($E_O$) value of from 1.1 to 1.8 (more preferably 1.18 to 1.6) inclusive. Most preferably the oxidising agent is an alkali metal or alkaline earth metal chlorate, bromate or iodate, more preferably a chlorate or a bromate, most preferably sodium bromate.

Preferably the amount of lignin sulphonate dispersing agent present is such as to disperse the disperse dye in a bath (preferably an exhaust dyebath), more preferably in an amount of 0.02 to 10 g/l of dyebath used.

$E_O$ values are described in "Fundamentals of Analytical Chemistry" (3rd Edition)—D. A. Skoog and D. M. West published by Holt-Saunders International Editions. Pages 780 to 782 inclusive of this publication are incorporated herein by reference.

Further according to the invention there is provided a composition, for addition to a dyebath comprising a) a complexing agent as defined above, preferably citric acid; and
b) an oxidising agent as defined above, preferably an alkali or alkaline earth metal chlorate or bromate.

Further, according to the invention, there is provided a composition, for addition to a dyebath, comprising a) 50–70% by weight of a complexing agent as defined above; and
b) 50–30% by weight of an oxidising agent as defined above.

Dyeing of polyester-cellulosic fibers is usually carried out from 60° to 135° C. and dyeing of polyamide-cellulosic fibers is usually carried out at 60°-125° C. Certain copper containing direct or reactive dyes tend to dissociate at elevated temperatures e.g. above 100° C. and so liberate copper ions during the dyeing process. However, even where there is no liberation of copper at elevated temperatures, there is copper normally associated with but not complexed into a direct or a reactive dye that can interfere with the disperse dyeing. In this Specification "free copper" therefore refers to any copper ions present that are not complexed to the direct or reactive dye, whether present at the start of the dyeing process or produced by dissociation of the direct or reactive dye during the dyeing process.

The amount of "free copper" associated with a direct or reactive dye is calculated by visually comparing the negative effect (i.e. change in hue) of the direct or reactive dye on a disperse dye dyeing with the negative effect of various concentrations of a copper sulphate solution on a dyeing of the same disperse dye. Where the effect is the same the copper sulphate content is taken to be the "free copper content" for the direct or reactive dye. The amount of copper metal of a direct or reactive dye can also be determined by Atom Absorption Spectroscopy (for example as described in Flame Emission and Atomic Spectroscopy—John R. Dean, Vol. 1 Chapter 1, [III]). A Perkin Elmer Spectrometer is preferably used.

Preferably the ratio of the amount of complexing agent to the amount of free copper present in the dyeing process is 20:1 to 1000:1 by weight.

When dyeing according to the invention is carried out at temperatures above 100° C. and the copper-containing direct or reactive dye used in the process is one that liberates copper during the process, preferably the ratio of complexing agent to free copper is 500:1 to 1000:1. Where in the dyeing process no copper is liberated during the process the amount of complexing agent to free copper is 20:1 to 100:1.

Preferably the amount of oxidising agent present is from 30 to 100% of the amount of complexing agent present.

Preferably a process according to the invention is carried out in an aqueous dye bath by exhaustion dyeing.

Preferably the process is carried out in a single dyebath.

Preferably the temperature of the dyebath in a single bath process is raised from 60°-125°-135° C. during the dyeing process. Preferably dyeing with the disperse dye is carried out at 125° to 135° C. for 15 to 45 minutes and preferably dyeing with the direct or reactive dye is carried out at 60° to 80° C. for 15 to 45 minutes.

Preferably a process according to the invention is carried out using at least one disperse dye and at least one direct dye.

Preferably a process according to the invention is carried out in a machine for jet dyeing, preferably fully flooded. A preferred fully flooded jet dyeing is beam dyeing.

Preferably the pH of a process according to the invention is 4-6, more preferably 4 to 5.5.

In a process according to the invention further standard additives, such as Gluber salt and anionic dispersing agents may be used.

Preferred polyester/cellulosic substrates are polyester/cotton and polyester/viscose.

Preferably in a process according to the invention the polyester- or polyamide-cellulosic substrate is aftertreated with one or more of the following products:

$A_1$) the product of reacting a mono- or polyfunctional primary or secondary amine with cyanamide, dicyandiamide, guanidine or biguanidine whereby up to 50 mole % of the cyanamide, dicyandiamide, guanidine or biguanidine may be replaced with a dicarboxylic acid or mono- or di-esters thereof, the product containing reactive hydrogen bound to nitrogen; or $A_2$) the product of reacting $A_1$ above with an N-methyl derivative of a urea, melamine, guanamine, triazinone, urone, carbamate or acid amide optionally in the presence of a catalyst for crosslinking of N-methylol compounds of the above type; or $A_3$) the product of reacting $A_1$ above with epichlorohydrin.

Products $A_1$ and $A_2$ are described in British Patent No. 2,070,006B and U.S. Pat. No. 4,410,652 and Products $A_3$ are described in British Published Patent Application No. 2,142,642 A and U.S. Pat. No. 4,439,203 and U.S. Pat. No. 4,559,058 the contents of which are all incorporated by reference, and their method of application generally.

Preferably a composition for addition to a dyebath according to the invention is used in an amount of 0.2 to 1.5 g/l of an aqueous dyebath in a process according to the invention.

The invention will now be illustrated by the following Examples in which all parts and percentages are by weight based on the amounts of substrate used and all temperatures are in °C. unless stated to the contrary. In the Examples, the amount of lignin sulphonate dispersing agent used is 2-5 g/l of dyebath used.

EXAMPLE 1

A dyeing bath is made up as given in Table 1 below and the pH is brought to 5 by the addition of formic acid.

5 g of a cellulose/polyester (50:50) substrate are placed into a 75 cms$^3$ dyeing bath at a goods to liquor ratio of 1:15 at 60° C. and the temperature is raised from 60°-135° C. at 2° C. per minute. The temperature is maintained at this temperature for 30 minutes and the bath is drained from the dyeing. The dyeing is then cold rinsed with water.

The dyeing is then aftertreated with the product of reacting the condensation product of dicyanodiamide and diethylene triamine with epichlorohydrin.

TABLE 1

| | | |
|---|---|---|
| a) Recipe 1 containing the following: | | |
| | 2.3% | CI Disperse Blue 79 |
| | 0.11% | CI Disperse Brown 19 |
| | 0.018% | CI Disperse Violet 33 |
| | 0.53% | CI Direct Blue 251 |
| | 0.26% | CI Direct Green 69 and |
| | 0.26% | CI Direct Red 83 ; |
| b) | 20 g/l | Glauber salt |
| | 1 g/l | ammonium sulphate; and |
| c) | 0.5 g/l | sodium citrate and |
| | 0.2 g/l | sodium bromate. |

Example 1 is repeated using 1.0 g/l instead of 0.5 g/l of sodium citrate and 0.5 g/l instead of 0.2 g/l sodium bromate.

After dyeing, the substrate is rinsed well and treated in 1.5% (based on the weight of substrate) of the reaction product of 103 parts of diethylene triamine and 84 parts of dicyandiamide (prepared according to Example 1 of U.S. Pat. No. 4,410,652) and 5 g/l of sodium sulphate at a goods to liquor ratio of 1:15. The bath is raised from room temperature to 60° C., aftertreated for 20 minutes at 60° C. and rinsed with water.

EXAMPLE 2

Example 1 is repeated using Recipe 2 below instead of Recipe 1

| Recipe 2 is as follows: | | |
|---|---|---|
| 2.5% | of a mixture of | CI Disperse Blue 183<br>CI Disperse Blue 81<br>CI Disperse Blue 180<br>CI Disperse Blue 79<br>CI Disperse Violet 63<br>CI Disperse Orange 25 and<br>CI Disperse Orange 96 |
| 0.6% | of a mixture of | CI Disperse Orange 30,<br>CI Disperse Violet 93:1, and<br>CI Disperse Blue 79, |
| 0.3% | of | CI Disperse Yellow 235 |
| 3.0% | of a mixture of | C.I.Direct Yellow 162,<br>C.I.Direct Red 261,<br>C.I.Direct Blue 90, and<br>C.I.Direct Brown 240; and |
| 0.2% | of a mixture of | C.I.Direct Yellow 162,<br>C.I.Direct Red 261,and<br>C.I.Direct Blue 90. |

EXAMPLE 3

Example 1 is repeated using Recipe 3 below instead of Recipe 1.

| Recipe 3 is as follows: | | |
|---|---|---|
| 2.7% | of a mixture of | CI Disperse Orange 30<br>CI Disperse Blue 79<br>CI Disperse Violet 93.1 and<br>CI Disperse Red 54; |
| 3.7% | of a mixture of | C.I.Direct Yellow 162,<br>C.I.Direct Red 261,<br>C.I.Direct Blue 90, and<br>C.I.Direct Brown 240. |

EXAMPLE 4

Example 1 is repeated using Recipe 4 below instead of Recipe 1.

| Recipe 4 is as follows: | | |
|---|---|---|
| 4.4% | of a mixture of | C.I.Direct Yellow 162,<br>C.I.Direct Red 261,<br>C.I.Direct Blue 90, and<br>C.I.Direct Brown 240,and |
| 3.0% | of a mixture of | C.I.Disperse Red 54,<br>C.I.Disperse Orange 30, and<br>C.I.Disperse Blue 79. |

EXAMPLE 5

Example 1 is repeated using Recipe 5 below instead of Recipe 1.

| Recipe 5 is as follows: | | |
|---|---|---|
| 2.0% | of a mixture of | C.I.Direct Yellow 162,<br>C.I.Direct Red 269,<br>C.I.Direct Blue 90, and<br>C.I.Direct Brown 240, |
| 0.42% | of a mixture of | C.I.Direct Yellow 162,<br>C.I.Direct Red 261, and<br>C.I.Direct Blue 90; and |
| 5.6% | of a mixture of | C.I.Disperse Brown 19,<br>C.I.Disperse Violet 93:1, and<br>C.I.Disperse Blue 291. |

-continued

EXAMPLE 6

Example 1 is repeated using Recipe 6 below instead of Recipe 1.

| Recipe 6 is as follows: | | |
|---|---|---|
| 1.0% | of a mixture of | C.I.Direct Yellow 162,<br>C.I.Direct Red 261,<br>C.I.Direct Blue 90, and<br>C.I.Direct Brown 240, |
| 0.15% | of a mixture of | CI Disperse Orange 37; and |
| 6.0% | of a mixture of | Serilene Black VX-RL<br>containing C.I.Direct Blue 291. |

EXAMPLE 7

Example 1 is repeated using Recipe 7 below instead of Recipe 1.

| Recipe 7 is as follows: | | |
|---|---|---|
| 0.22% | of | C.I.Disperse Yellow 235, |
| 2.0% | of a mixture of | C.I.Direct Yellow 162,<br>C.I.Direct Red 261,<br>C.I.Direct Blue 90, and<br>C.I.Direct Brown 240, |
| 0.8% | of a mixture of | C.I.Direct Yellow 162,<br>C.I.Direct Red 261,<br>C.I.Direct Blue 90, |
| 2.0% | of a mixture of | CI Disperse Orange 30<br>CI Disperse Blue 79<br>CI Disperse Violet 93:1 and<br>CI Disperse Red 54; and |
| 0.9% | of a mixture of | CI Disperse Orange 30,<br>CI Disperse Violet 93:1, and<br>CI Disperse Blue 79. |

What is claimed is:

1. A process for dyeing a mixed polyester/cellulose or polyamide/cellulose fibrous substrate comprising applying to the substrate by exhaust dyeing in an aqueous dyebath at a temperature in the range 60°-135° C.:
a) at least one disperse dye;
b) at least one copper-containing direct or reactive dye;
c) a complexing agent having a K-value with the metal of the direct or reactive dye of from 6 to 17 inclusive;
d) a lignin sulphonate dispersing agent; and
e) an oxidizing agent capable of converting copper (I) to copper (II) at a temperature of 100°-130° C. at a pH of 5 to 7 in the process for dyeing the mixed substrate and selected from the group consisting of alkali metal and alkaline earth metal chlorates, bromates and iodates.

2. A process according to claim 1, in which the oxidising agent is sodium bromate.

3. A process according to claim 1, in which the complexing agent has a K-value of 10 to 17 inclusive.

4. A process according to claim 1, in which the complexing agent is selected from citric acid, biguanide, aminotrimethylene phosphonic acid, ethylene diamine and glycine and derivatives of each of the above-mentioned complexing agents.

5. A process according to claim 1, in which the complexing agent is sodium citrate.

6. A process according to claim 1, which is carried out using at least one disperse dye and at least one copper containing direct dye.

7. A process according to claim 6, in which the direct dye is selected from

C.I. Direct Blue 90
C.I. Direct Brown 240 and
C.I. Direct Red 261.

8. A process according to claim 1, in which the pH is from 4 to 6 inclusive.

9. A process according to claim 1, in which the ratio of complexing agent to free copper associated with the copper containing direct or reactive dye is 20:1 to 1000:1.

10. A process according to claim 1, in which the dyed substrate is aftertreated with one or more of the following products:

$A_1$) the product of reacting a mono- or polyfunctional primary or secondary amine with cyanamide, dicyandiamide, guanidine or biguanidine whereby up to 50 mole % of the cyanamide, dicyandiamide, guanidine or biguanidine may be replaced with a dicarboxylic acid or mono- or diesters thereof, the product containing reactive hydrogen bound to nitrogen; or $A_2$) the product of reacting $A_1$ above with an N-methylol derivative of a urea, melamine, guanamine, triazinone, urone, carbamate or acid amide optionally in the presence of a catalyst for cross-linking of N-methylol compounds of the above type; or $A_3$) the product of reacting $A_1$ above with epichlorohydrin.

11. A mixed polyester/cellulose or polyamide/cellulose fibrous substrate which has been dyed by exhaust dyeing in an aqueous dyebath at a temperature in the range 60°-135° C. with at least one disperse dye and at least one copper-containing direct and/or reactive dye in the presence of a complexing agent having a K-value with the metal of the direct or reactive dye of from 6 to 17 inclusive and an oxidizing agent capable of converting copper (I) to copper (II) at a temperature of 100°-130° at a pH of 5 to 7 in the process for dyeing the mixed substrate, said oxidizing agent being selected from the group consisting of alkali metal and alkaline earth metal chlorates, bromates and iodates.

12. A process according to claim 1 wherein the copper-containing dye is employed in a sufficient amount to produce a dyeing of greater than 1/1 standard depth on the substrate.

13. A process according to claim 1 wherein components a) to e) are applied at the same time to the substrate.

14. A process according to claim 1, wherein a disperse dye is applied which is susceptible to shade change by metals according to a modified version of ISO Test ZO2, the modification being that the polyester dyeing is carried out in the presence of a metal salt at 130° C. rather than 98° C.

15. A process according to claim 14, wherein the disperse dye has a value in the range 1-4 according to modified ISO Test ZO2.

16. A process according to claim 1 which comprises applying a disperse dye selected from C.I. Disperse Blue 79
C.I. Disperse Blue 81
C.I. Disperse Blue 180
C.I. Disperse Blue 183
C.I. Disperse Blue 291
C.I. Disperse Violet 63
C.I. Disperse Violet 93:1
C.I. Disperse Blue 56 and
C.I. Disperse Blue 73.

17. A process according to claim 1 wherein, where the copper of the direct or reactive dye and the complexing agent have more than one K-value, then the K-value is that for the copper and complexing agent in a medium at pH 4 to 5.5 and a temperature of 100° to 140° C.

18. A process according to claim 1 which is carried out in a single dyebath.

19. A process according to claim 1 wherein the amount of lignin sulphonate is such as to disperse the disperse dye in the dyebath.

20. A process according to claim 19 wherein the amount of lignin sulphonate is 0.02 to 10 g/l of dyebath.

21. A process according to claim 18 wherein the temperature of the dyebath is raised from 60° to 125°-135° during the dyeing.

22. A process according to claim 18 wherein the complexing agent is selected from citric acid, biguanide, aminotrimethylene phosphonic acid, ethylene diamine, and glycine and salts of each of the above-mentioned complexing agents.

23. A process according to claim 22 wherein the ratio of complexing agent to free copper associated with the copper-containing direct or reactive dye is 20:1 to 1000:1 and the amount of oxidizing agent present is from 30 to 100% of the amount of complexing agent present.

24. A composition according to claim 23 wherein the amount of lignin sulphonate is such as to disperse the disperse dye in the dyebath.

25. A process according to claim 24 which is carried out using at least one disperse dye which is susceptible to shade change by metals according to a modified version of ISO Test ZO2, the modification being that the polyester dyeing is carried out in the presence of a metal salt at 130° C., rather than 98° C., and at least one copper-containing direct dye and wherein the dyes are employed in a sufficient amount to produce a dyeing of greater than 1/1 standard depth on the substrate.

26. A process according to claim 25 wherein the oxidizing agent is sodium bromate and the complexing agent is sodium citrate.

27. A process according to claim 25 wherein components a) to e) are applied at the same time to the substrate.

28. A process according to claim 25 wherein the temperature of the dyebath is raised from 60° to 125°-135° C. during the dyeing and the pH is from 4 to 6 inclusive.

29. A composition according to claim 3 wherein the amount of oxidizing agent present is from 30 to 100% of the amount of complexing agent present.

30. A process according to claim 4 wherein the complexing agent is selected from citric acid, biguanide, aminotrimethylene phosphonic acid, ethylene diamine, glycine and salts of each of the above-mentioned complexing agents.

31. A process according to claim 15 which is carried out using at least one disperse dye which is susceptible to shade change by metals according to a modified version of ISO Test ZO2, the modification being that the polyester dyeing is carried out in the presence of a metal salt at 130° C. rather than 98° C., and at least one copper-containing direct dye and wherein the dyes are employed in a sufficient amount to produce a dyeing of greater than 1/1 standard depth on the substrate.

32. A process according to claim 27 which comprises applying a disperse dye selected from C.I. Disperse Blue 79
C.I. Disperse Blue 81
C.I. Disperse Blue 180
C.I. Disperse Blue 183
C.I. Disperse Blue 291
C.I. Disperse Violet 63
C.I. Disperse Violet 93:1
C.I. Disperse Blue 56 and
C.I. Disperse Blue 73.a

* * * * *